US006560834B1

(12) United States Patent
Wirth

(10) Patent No.: US 6,560,834 B1
(45) Date of Patent: May 13, 2003

(54) DEVICE FOR FORMING METALLIC CAGES FOR REINFORCEMENT AND RELATIVE DEVICE

(75) Inventor: Marcel Wirth, Meisterschwanden (CH)

(73) Assignee: BCD Marcel Wirth - Bending and Cutting Devices, Zug (CH)

( * ) Notice: Subject to any disclaimer, the term of this patent is extended or adjusted under 35 U.S.C. 154(b) by 0 days.

(21) Appl. No.: 09/529,031

(22) PCT Filed: Sep. 30, 1998

(86) PCT No.: PCT/IB98/01517

§ 371 (c)(1),
(2), (4) Date: Aug. 9, 2000

(87) PCT Pub. No.: WO99/17896

PCT Pub. Date: Apr. 15, 1999

(30) Foreign Application Priority Data

Oct. 6, 1997 (IT) ..... UD97A0177
Nov. 18, 1997 (IT) ..... UD97A0214

(51) Int. Cl.[7] ..... B21B 15/00

(52) U.S. Cl. ..... 29/33 F; 29/787; 29/281.3; 29/897.34; 140/112

(58) Field of Search ..... 140/112; 29/33 Q, 29/33 F, 33 K, 897, 897.15, 897.31, 897.34, 281.3, 787, 822, 795, 428; 269/41, 43, 45, 909; 219/56, 80

(56) References Cited

U.S. PATENT DOCUMENTS 1,928,534 A * 9/1933 Halkyard et al. ..... 219/56
3,213,898 A * 10/1965 Grady et al. ..... 140/112
3,370,150 A * 2/1968 Nordgren ..... 140/112
3,706,331 A * 12/1972 Pennington ..... 140/112
3,749,140 A * 7/1973 Debry ..... 140/112
3,837,372 A * 9/1974 Bernot ..... 140/112
4,538,042 A * 8/1985 Tanaka et al. ..... 219/56
5,665,254 A * 9/1997 Isono et al. ..... 219/56
6,148,873 A * 11/2000 Mehre ..... 140/112
6,223,785 B1 * 5/2001 Barden ..... 140/112

FOREIGN PATENT DOCUMENTS

JP 6-226387 * 8/1994

* cited by examiner

*Primary Examiner*—Gregory M. Vidovich
*Assistant Examiner*—Trinh Nguyen
(74) *Attorney, Agent, or Firm*—Antonelli, Terry, Stout, & Kraus, LLP

(57) ABSTRACT

A device forms metallic cages for structures made of reinforced concrete, the metallic cages providing longitudinal rods associated with transverse stirrups, the transverse stirrups having an at least partly closed shape and being distanced lengthwise. The device includes a supporting frame, and a plurality of housing seatings arranged in a longitudinal line on the supporting frame at least according to a desired interaxis ("i") or a multiple of the interaxis ("i"), each of the housing seatings cooperating with a relative means to position and retain the stirrups defining their erect position on a substantially vertical plane. A plurality of transverse arms to support the longitudinal rods lie separated from each other on a horizontal plane, the transverse arms being interposed between the housing seatings. Means are provided for relative displacement in height between the transverse arms and the means to position and retain the stirrups.

40 Claims, 9 Drawing Sheets

DEVICE FOR FORMING METALLIC CAGES FOR REINFORCEMENT AND RELATIVE DEVICE

BACKGROUND OF THE INVENTION

This invention concerns a method to form metallic cages for reinforcement purposes and the relative device.

The invention is employed to facilitate, accelerate and simplify the positioning of the stirrups and the longitudinal rods in metallic cages, and also the operations to attach the rods to the stirrups.

The metallic cages as used with the invention are employed as reinforcement in load-bearing structures in reinforced concrete such as beams, pillars, foundations, etc.

Metallic cages used in load-bearing structures in reinforced concrete comprise a plurality of longitudinal rods, normally round pieces, possibly ribbed and/or shaped, with which a plurality of transverse stirrups, distanced lengthwise, are associated.

The stirrups can be of any shape whatsoever, for example polygonal, circular, in a mesh, etc., at least partly closed.

In the state of the art, the metallic cages are assembled manually, for the most part, because, among other reasons, it is difficult to automate the assembly operations; these difficulties derive from the great variety of the structural characteristics of the metallic cages.

The composition of the metallic cage varies both according to the geometry of the load-bearing structure where they are to be used, and also according to the stress to which the structures are subjected.

Therefore, it often happens that metallic cages which are equivalent in size and geometry have to reinforced with a variable number of rods, or with reinforcement rods arranged differently inside the stirrup, or with stirrups having a differentiated interaxis.

This causes considerable operating difficulties for the assembly workers who are obliged to perform continuous measurements before welding, with a high risk of error.

Another considerable problem is the positioning of the longitudinal rods, which can reach lengths of as much as 12 meters and more, inside the stirrups, or inserting the stirrups outside the rods if the rods are already arranged positioned on trestles or other supporting means.

A further considerable problem is to maintain the longitudinal rods and the stirrups in position during the welding and tying operations.

Yet another problem is to ensure the axial alignment of the longitudinal rods.

All these problems become even more important when the stirrups to be assembled are wide, because of the difficulty of positioning and supporting them in an erect position while the cage is: being formed.

There are solutions known to the art which use partly automated machines, or cage-producing machines, which limit the manual operations required for assembling the cage and make the operations for the workers easier.

These machines comprise means to retain and position the longitudinal rods cooperating with movable means to transport and position the stirrups in a controlled manner.

The movable means, as they move parallel to the longitudinal rods, allow the stirrups to be picked up and progressively distributed by the worker along the whole length of the cage.

Although such machines are extremely efficient, they may be too complex, sophisticated and over-sized for requirements, they need heavy investment, equipping operations, complex systems to move and control them, large spaces for manoeuvring, and equipment which requires constant maintenance and constant attention by the workers.

Moreover, in the case of very large metallic cages, the machines are unsuitable to support and stably maintain the stirrups to be assembled in an erect position, especially when the latter are very wide.

Therefore, if on the one hand these machines meet the need of automating the construction of a metallic cage almost completely, on the other hand they have problems of expense, simplicity and practicality, both during construction and during use.

U.S. Pat. No. 5,350,162 describes a device to form metallic cages comprising a plurality of pairs of retaining elements with a vertical development able to be reciprocally separated according to desired values in both a longitudinal and transverse direction, which serve to position the longitudinally separated stirrups in an erect position.

The rods to be attached to the corners of said stirrups are inserted longitudinally inside the stirrups.

This document does not provide in any way to vertically displace the rod support elements with respect to the stationary stirrups, or vice versa, in order to facilitate the positioning and attachment of the rods to the various vertical levels of the stirrups.

Therefore, with this device, to position the rods at the highest levels inside the stirrup, at least two people need to raise one rod at a time, holding it at the end, and take it to the desired level, and a third person has to carry out the attachment operation; otherwise, the same person has to support the rod with one band while at the same time he does the tying operation with the other hand.

It is obvious that this operation not only necessarily requires the intervention of at least two people, but also involves a considerable physical effort and considerable care, with the risk on the one hand of making an unsatisfactory attachment and on the other hand of causing accidents, particularly in the case of very long and heavy rods.

Another disadvantage comes from the fact that, if on the one hand there is no problem of positioning in the case when the rods are attached only in correspondence with the upper inner corners of the rod, on the other hand, in the case when the rods are positioned at one or more intermediate levels in height, a considerable problem is created concerning the accuracy of the positioning.

In this case, which is the more frequent one in the production of metallic cages, the workers are obliged to take reference measurements on the sides of the stirrup according to the design specifications of the cage, and then try to respect these reference measurements while they are supporting long, heavy rods at the ends and tying them.

EP-A-0.376.765 describes the use of identification elements to indicate the position where the stirrups have to be located with respect to the longitudinal rods.

This document does not describe a method or a device to facilitate the formation of a metallic cage.

The present applicants have designed, tested and embodied this invention to overcome the shortcomings of the state of the art with a solution which combines efficiency, practicality, versatility, flexibility and economy, and also to obtain further advantages as will be shown hereinafter.

BRIEF SUMMARY OF THE INVENTION

The purpose of the invention is to provide a device to form metallic cages which will accelerate, simplify and rationalise the operations to position the rods and stirrups, whatever their size, and also the operations of welding or tying in the assembly steps.

The invention also makes possible to vary the interaxis between the stirrups extremely quickly, and to position the longitudinal rods in the correct positions established by the design plans of the cage, without carrying out manual measurements which often cause errors and lead to time being wasted.

The invention uses a plurality of seatings for means to position and retain the stirrups; the seatings are distributed lengthwise along the length of the cage to be formed.

Moreover, the invention includes means to support and position the longitudinal rods of the cage to be assembled; these means are arranged at intervals along the length of the cage.

The seatings for means to position and retain the stirrups are arranged lengthwise with a pre-defined interaxis, either fixed or variable, and cooperate with marker means which identify the position of the stirrups to be inserted according to the design specifications of the cage to be made.

In a first embodiment, the marker means are manual and the workman applies a marker element from time to time in correspondence with the seating where the stirrup is to be inserted.

According to a variant, the marker means are commanded by remote control means and consist of visual indicators which light up in correspondence with the seating where the stirrup is to be inserted.

According to a further variant, when the worker prepares to begin the first cage in a series of identical cages, he inserts the individual stirrups, which causes the light signal to be activated; at the end of the series the light signal is cancelled.

In another embodiment, the marker means consist of a chain, belt, conveyor, etc., which can move lengthwise to the frame of the device, to which a marker element is attached; the chain, belt, conveyor, etc. is stopped from time to time, to arrange the marker element in the position where the stirrup is to be inserted.

In a variant of the invention, the interaxis between the housing seatings is a sub multiple of a range of defined interaxes of the stirrups.

In one embodiment of the invention, the interaxis is 50 mm.

According to a variant, to form cages with stirrups closer together the interaxis is 25 mm.

According to a variant, all the available seatings are occupied by means to position and retain the stirrups, of which only some are used during the formation of the cage; those to be used are identified by the marker means.

In a referential form of this embodiment, the means to position and retain the stirrups are made on profiles arranged between the means to support and position the longitudinal rods.

According to another variant, the means to position and retain the stirrups can be extracted from the relative housing seating and are positioned from time to time in the appropriate seatings identified by the marker means.

According to a further variant, the means to position and retain the stirrups can slide along guides which are longitudinal to the machine and are positioned from time to time according to the marker means.

In this last embodiment, only a limited number of means to position and retain the stirrups are needed compared with the range of interaxes which the stirrups have to assume along the cage.

In one embodiment, the means to position and retain the stirrups consist of a pair of adjacent sections defining a channel to contain the stirrups.

According to the invention, one of the adjacent sections is stationary and one is movable.

According to a variant, the sections are both movable.

During the initial positioning step, the two elements are placed at a distance from each other to allow the stirrups to be inserted easily; the latter are arranged as desired on a substantially vertical plane inside the containing channel.

When the initial positioning has been concluded, the positioning and retaining means are clamped against the stirrup, locking it into the erect position lying on a plane substantially orthogonal to the longitudinal plane of the cage to be formed.

According to a variant, the positioning and retaining means consist of a single angle section, the rear part of which is cone-shaped and serves for positioning.

The means to support and position the longitudinal rods consist of a plurality of transverse arms orthogonal to the axis of the cage and arranged at intervals on a plane substantially parallel to the lower plane on which the cage lies.

According to a first embodiment, the transverse arms, which are interposed between the means to position and retain the stirrups, are movable at least vertically so as to position the longitudinal rods in cooperation with the stirrup at various heights during the attachment steps.

According to a variant, the means to vertically move the transverse arms are associated with means to measure and display the movement.

According to a further variant, there are seatings to guide the longitudinal rods on the transverse arms.

According to another variant, the transverse arms are lined with wear-resistant material.

According to another variant, the transverse arms can be associated with extension elements of the rapid replacement type which allow the longitudinal rods to be positioned and supported in a suitable manner even when the cage has a considerable width.

The extension elements are of different lengths and are used according to the width of the cage to be formed.

According to a variant, the transverse arms are stationary while the means to position and retain the stirrups are movable vertically to obtain the reciprocal positioning in height of the longitudinal rods and the stirrups during the step of forming the cage.

According to the invention, the procedure to form the cage is as follows: first the stirrups are inserted, at an interaxis given by the design specifications, into the relative positioning and retaining means, which means are identified by the marker means.

Then, the transverse arms are slightly raised with respect to the lower plane of the stirrup.

In the case when the arms are stationary, all the stirrups are slightly lowered with respect to the plane defined by the transverse arms.

This relative movement in height of the stirrups and rods facilitates the insertion of the longitudinal rods inside the area defined by the stirrups, and avoids the risk of blockages or of the rods being obstructed.

When all the longitudinal rods have been inserted, the transverse arms are lowered again, or the stirrups are raised, resting all the rods on the side or lower segment of the stirrups.

The longitudinal rods are then all axially aligned lengthwise, using abutment elements arranged in cooperation with one end of the device, advantageously the forward end.

Then, all the longitudinal rods are taken substantially to the highest level of attachment required by the design of the cage, thus making it possible to begin the operations of attaching, welding, tying etc. the rods to the stirrup.

These operations are consequently much simpler, as the longitudinal rods rest on the transverse arms at the desired height with respect to the stirrups.

When the operation to attach the rods in a high position between inside the stirrup is concluded, the, reciprocal position of the stirrups with respect to the rods is varied until all the desired reciprocal positions are obtained, thus allowing the reciprocal attachment to be achieved.

In order to attach one or more longitudinal rods in correspondence with the segment of the stirrup which cooperates with the means to position and retain the stirrups, the cage formed at that point can be partly extracted at the side, freeing said segment of stirrup and enabling the relative longitudinal rod to be attached in said position.

According to a variant, the device has in an adjacent position a base with a sliding plane for a trolley to carry the stirrups or to support a welding machine; the sliding plane may include guide means for the trolley.

According to another variant, on the base there is a longitudinal supporting element to support stirrups which protrude at the side for a large segment of the lateral bulk of the device to form the cage.

According to a further variant, the longitudinal supporting element is movable transversely on the base so as to adapt its position according to the width of the stirrups to be supported.

According to a further variant, the longitudinal supporting element is attached to the base which can be moved in a transverse direction to the frame of the device to form cages.

In a first embodiment, the longitudinal supporting element, or the base, is moved manually.

According to a variant, it is moved by automated means.

The longitudinal supporting element allows the stirrups to be supported securely and therefore to be positioned more stably in their erect position; this is particularly useful when the stirrups tend to fall onto the working plane due to their width, their weight and their vertical arrangement.

According to a variant, the longitudinal supporting element has auxiliary positioning and retaining means arranged at the front, in a number mating with the positioning and retaining means on the opposite side of the device according to the invention; in this embodiment the marker means may be included on the longitudinal element also.

BRIEF DESCRIPTION OF SEVERAL VIEWS OF THE DRAWINGS

The attached Figures are given as a non-restrictive example and show some preferential embodiments of the invention as follows.

DETAILED DESCRIPTION OF THE INVENTION

Figure 1:
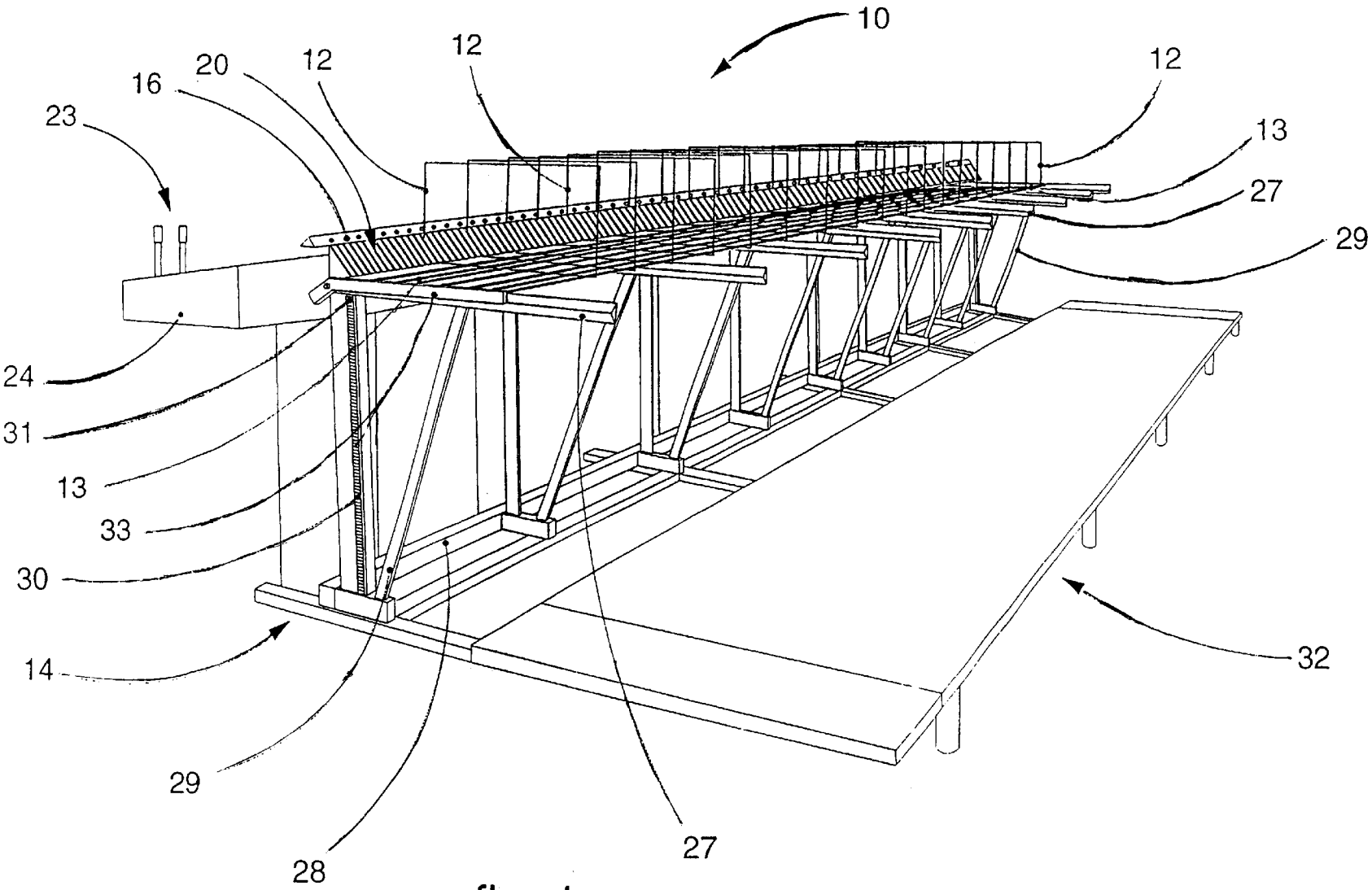
FIG. 1 shows a perspective view of the device to form metallic cages according to the invention in the first step of the cage-forming cycle.

With reference to the attached Figures, the number 10 denotes generally the device according to the invention to form metallic cages 11 for reinforcement comprising a plurality of longitudinal rods 13 associated with stirrups 12 placed transversely across the rods 13 and separated from each other according to pre-defined interaxes.

The device 10 comprises substantially a supporting frame 14, the length of which is correlated to the cage 11 which is to be formed; a plurality of seatings 15 for means 20 to position and retain the stirrups 12 are arranged on the frame 14. The seatings 15 develop substantially along the entire length of the supporting frame 14 and are arranged at an interaxis "i" correlated to the interaxis of the stirrups 12 to be arranged.

In the case described here, the stirrups 12 are rectangular; however, it is evident that the invention is applied equally well in the case of stirrups 12 which are circular, square, polygonal, meshed or any other desired shape, provided they are of a size which is compatible with the size of the positioning and retaining means 20.

In a preferential embodiment, the interaxis "i" has a value equal to a common sub multiple of a desired range of interaxes of the stirrups 12.

According to one embodiment of the invention, the interaxis "i" is 50 mm.

According to a variant, the interaxis "i" is 25 mm.

Each of the housing seatings 15 is associated with a visual marker element 16 which can be activated individually; the marker elements 16 are suitable to indicate the seatings 15 in correspondence with which the stirrups 12 are to be placed according to the design specifications of the cage 11 to be formed.

Figure 4:
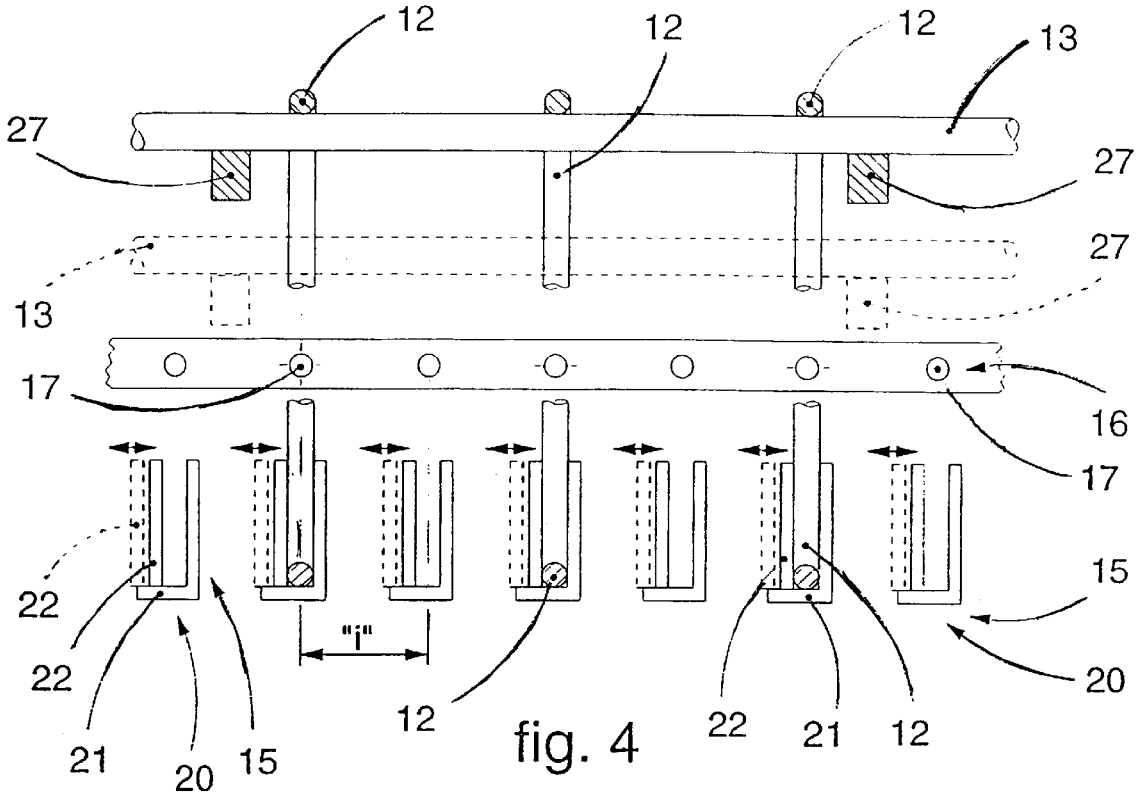
FIG. 4 shows in part and diagrammatically a front view of the device to form cages according to the invention.
Figure 8:
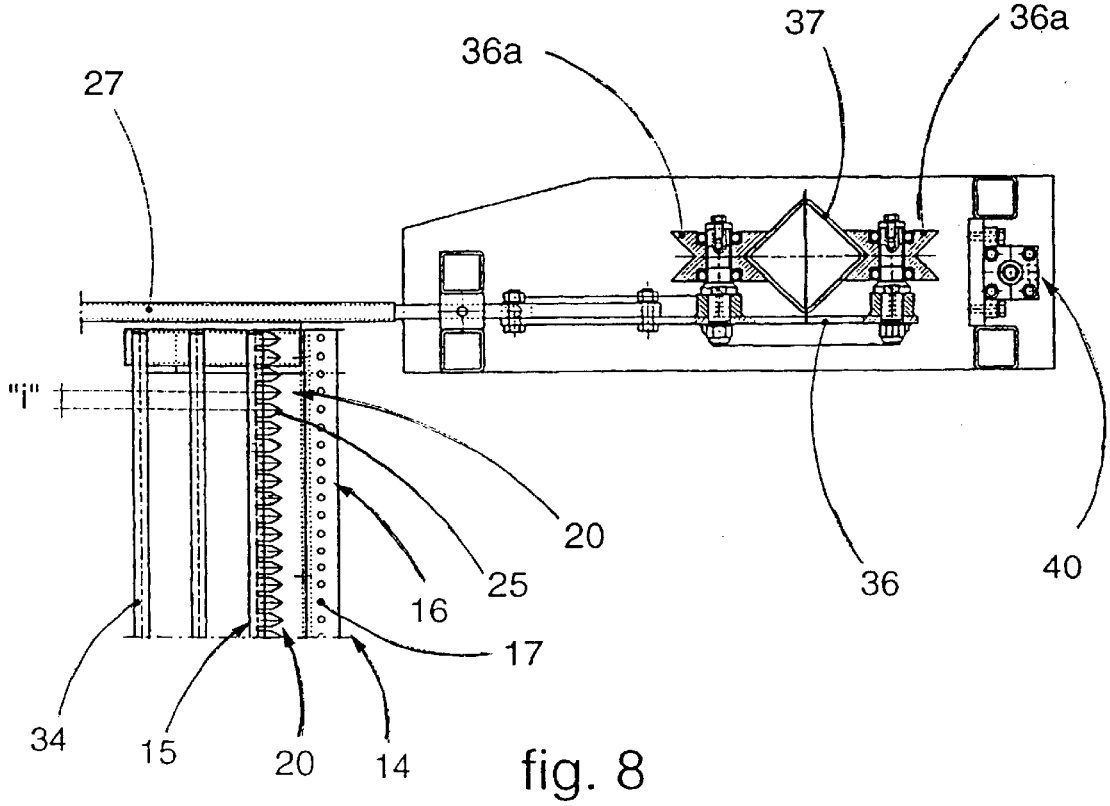
FIG. 8 shows a view from above of a detail of the device in FIG. 7.

In a first embodiment as shown in FIGS. 4 and 8, the marker elements 16 consist of LEDs 17.

According to the variant shown in FIGS. 5, 14*a*, 15 and 16, the marker elements 16 consist of pins 18 which can be inserted into mating holes 19 located in correspondence with each of the housing seatings 15.

According to a variant which is not shown here, the marker elements consist of a pin associated with a device arranged parallel and near the frame 14, for example of the chain type, which displaces the pin lengthwise to the device and stops it automatically in the positions where the worker has to insert the stirrup 12.

Figure 5:
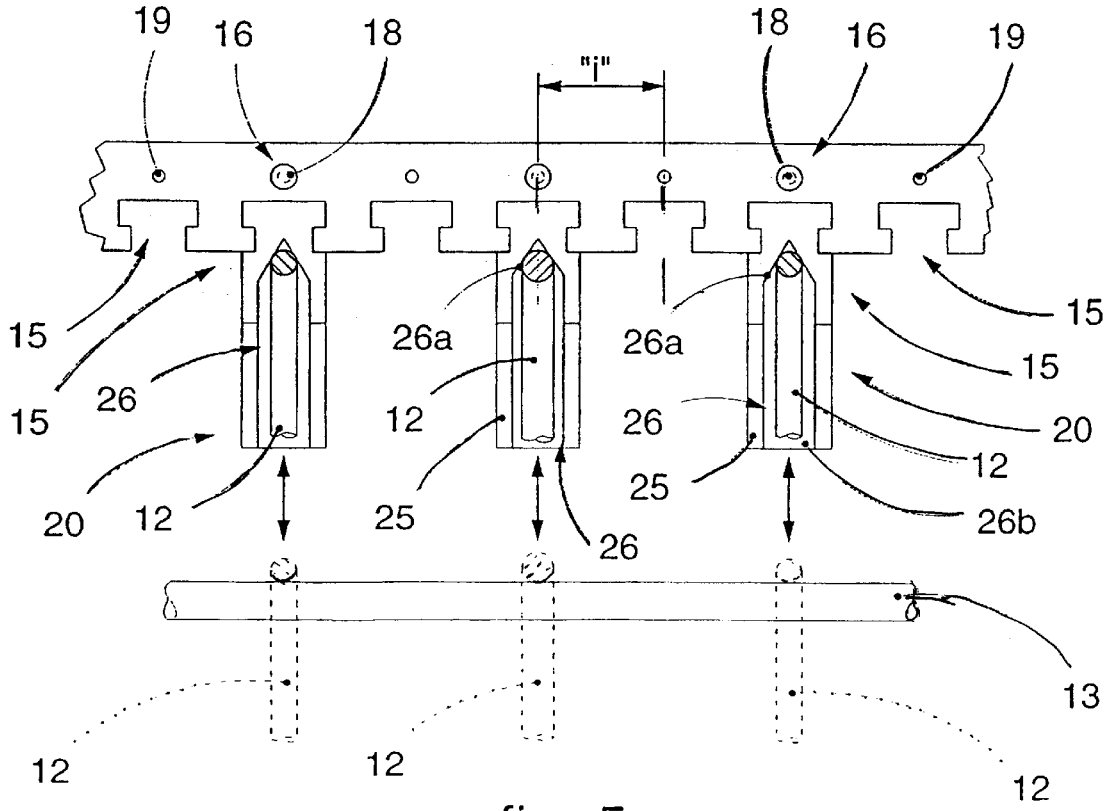
FIG. 5 shows in part and diagrammatically a view from above of the device to form cages according to a variant of the invention.
Figure 6:
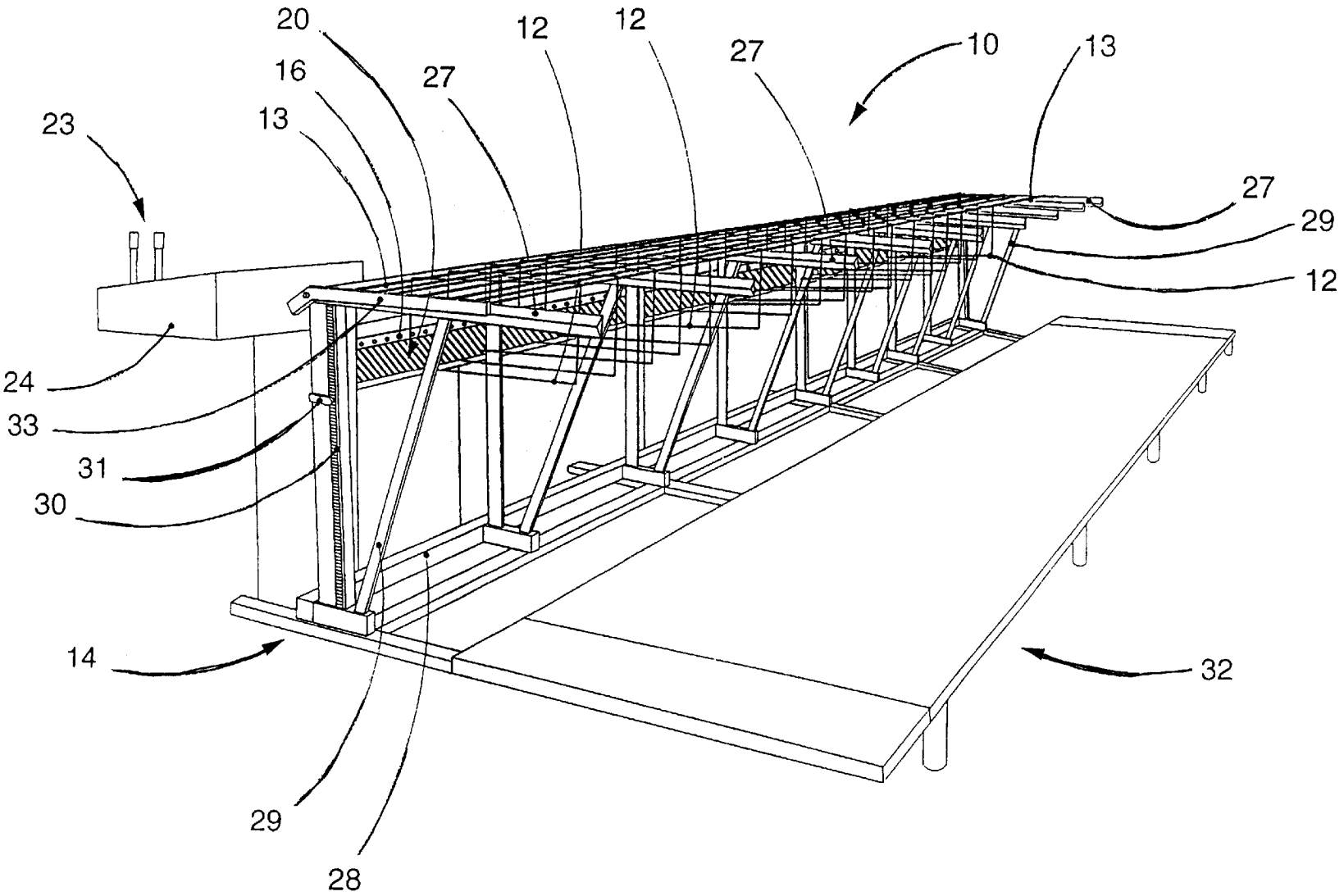
FIG. 6 shows a variant of FIG. 2 in the embodiment with stationary arms and movable stirrups.
Figure 7:
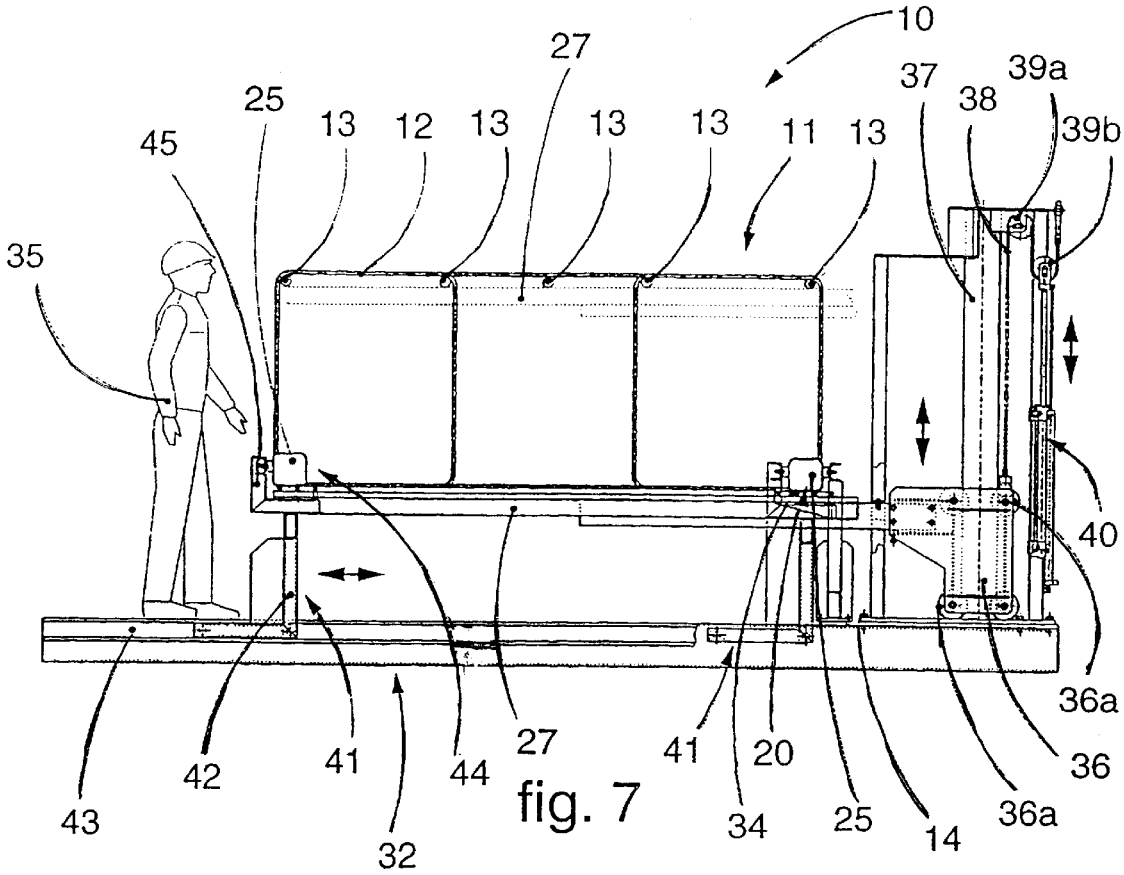
FIG. 7 shows a front view of a further embodiment of the device to form cages according to the invention.

In the specific case as shown in FIGS. 1–8, the positioning and retaining means 20 cooperate with a comer portion of the stirrup 12; the stirrups 12 can be supported at the lower part by supporting means 34, shown in FIGS. 7 and 8 and in this case consisting of tubular elements, solid with the supporting frame 14 and defining the base plane of the cage 11 to be formed.

In the embodiment shown in FIGS. 1–4 the positioning and retaining means 20 are permanently constrained to the relative housing seatings 15.

In this embodiment, each positioning and retaining means 20 consists of a pair of sections, one stationary 21 and one movable 22, between which the stirrup 12 is arranged and clamped.

In this case, the stationary section 21 consists of an angle piece closed at the rear.

The movable sections 22 consist of plates associated with supports connected to moving means, which are not shown in detail here.

The moving means are advantageously shared by all the movable sections 22 and are activated by commands 23 on the control console 24.

Moving the movable sections 22 from a first, wider position (show by a line of dashes) to a second, closed position (shown by a continuous line), pushes and clamps the stirrups 12 against the stationary section 21.

With the movable sections 22 in the second position, the stirrups 12 are clamped in a substantially erect position orthogonal to the longitudinal plane on which the cage 11 to be formed lies.

According to the variant shown in FIG. 5, the positioning and retaining means 20 can be removed from their relative housing seating 15, to allow them to be used in the appropriate number from time to time as necessary to clamp the stirrups 12 of the cage 11 to be formed.

In this embodiment, each positioning and retaining element 20 consists of a section 25 defining an insertion cavity 26 for the stirrup 12, the section 25 can be coupled and fitted into the relative housing seating 15.

The rear wall 26*a* of the insertion cavity 26 has a cuneiform development against which the stirrup 12 is pushed and clamped in contact in a position substantially orthogonal to the longitudinal plane on which the cage 11 lies.

According to a variant which is not shown here, there is a thruster element which pushes every stirrup 12 inside the section 25 and causes it to be clamped.

According to another variant, the stirrup 12 is clamped by the cuneiform base 26*b* of the insertion cavity 26.

According to yet another variant, both the base 26*b* and the rear wall 26*a* of the insertion cavity 26 are cuneiform in development.

By using removable positioning and retaining means 20, when the construction plans of the cage 11 so ordain, it is possible to use stirrups 12 of different diameter, using sections 25 of different width or with a more or less tapered cuneiform segment.

In the case of FIG. 5, for example, the central section 25 is wider than the lateral sections 25.

In the embodiment shown in FIGS. 7 and 8, the positioning and retaining means 20 consist of sections 25 substantially identical to those of FIG. 5.

The sections 25, in this case solidly associated with the supporting frame 14, are arranged with the interaxis "i" close together, to allow the formation of cages 11 with stirrups 12 likewise particularly close together.

In the preferential form of embodiment shown in FIGS. 9–16, the positioning and retaining means 20 consist of wedge-shaped hollows 47 made respectively on a plurality of L-shaped lateral profiles 46*a* and on a mating plurality of lower flat profiles 46*b*.

The wedge-shaped hollows 47 have a limited interaxis "i", advantageously of 25 mm, so that it is possible to make cages 10 with substantially any design specifications.

The stirrups 12 come into contact with the wedge-shaped hollows 47 and are clamped therein.

The L-shaped lateral profiles 46*a* (FIG. 14*a*) extend substantially for the entire length of the device 10 so as to define two parallel and facing rows of wedge-shaped hollows 47 and are suitable to receive the stirrups 12 from above, cooperating with the respective vertical segments of the stirrups 12 and clamping the stirrups 12 in position so that they do not oscillate on the vertical plane.

The lower flat profiles 46*b* (FIG. 14*b*) extend on a plane below that of the L-shaped lateral profiles 46*a* for the whole length of the device 10 and are suitable to cooperate with the lower horizontal segment of the stirrups 12, defining the supporting plane (FIGS. 15 and 16) on which the stirrups 12 rest.

This embodiment makes it extremely quick and easy to insert and position the stirrups 12 along the device 10, and also guarantees that the stirrups 12 are stably clamped in an erect position, which makes the subsequent welding of the longitudinal rods 13 considerably easier and more precise.

The device, 10 according to the invention, moreover, comprises a plurality of transverse arms 27 to support the longitudinal rods 13 arranged in a line and at intervals along the supporting frame 14.

The transverse arms 27 are positioned at desired intervals, provided that they guarantee an efficient support for the longitudinal rods 13, and are arranged between the housing seatings 15.

Figure 9:
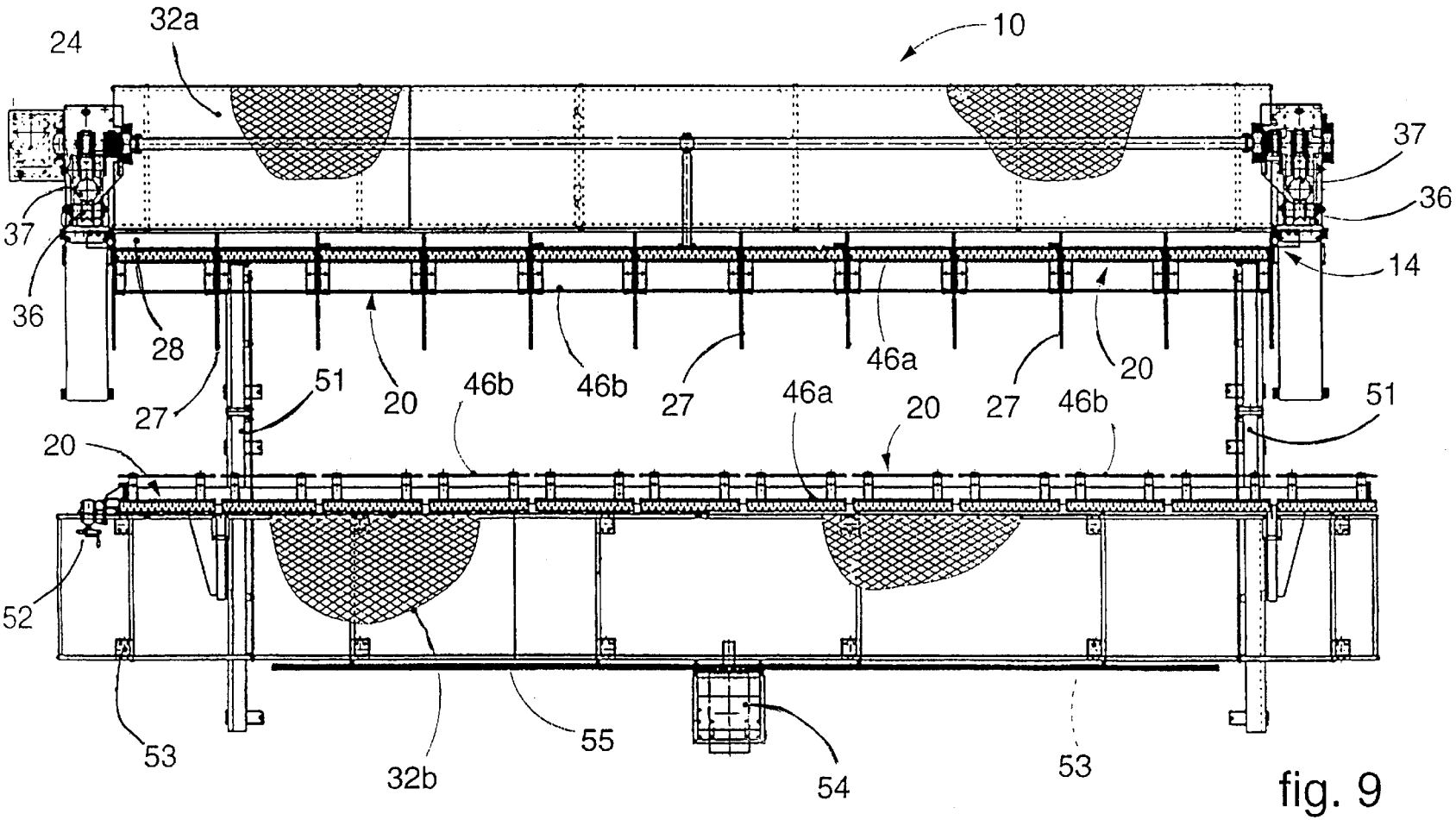
FIG. 9 is a view from above of a preferential embodiment of the device to form cages according to the invention.
Figure 10:
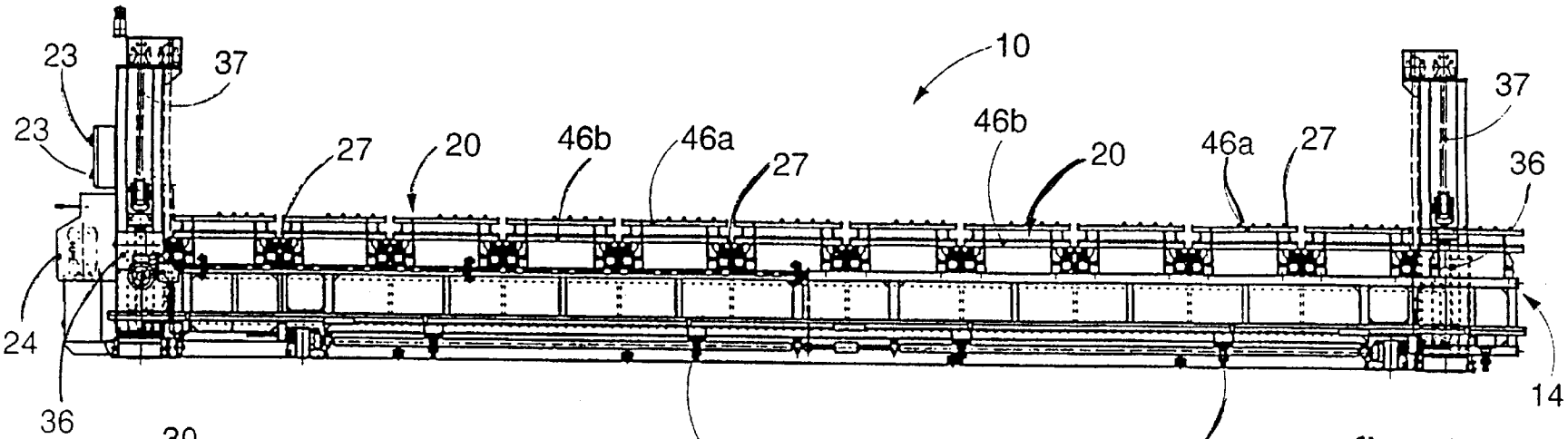
FIG. 10 is a side view of the device to form cages of FIG. 9.

In the embodiment shown in FIGS. 9 and 10, the transverse arms 27 are arranged at an intermediate position between the L-shaped lateral profiles 46*a* and the lower flat profiles 46*b*, each of the L-shaped lateral profiles 46*a* and the lower flat profiles 46*b* extending for a length equal to the net gap between two of the transverse arms 27.

The transverse arms 27, in the embodiment shown in FIGS. 1–3 and 7–13, can be moved from a lowered position, wherein they lie substantially on the base plane of the cage 11, to apposition wherein they are completely raised and which defines the maximum height of the cage 11 itself.

This maximum height corresponds to a value which allows the worker 35 to carry out the operations of attachment, welding or tying in a comfortable and operationally functional manner.

The transverse arms 27 moreover are arranged in an intermediate position between the supporting means 34 for the stirrups 12, in such a way as to not interfere therewith.

Figure 2:
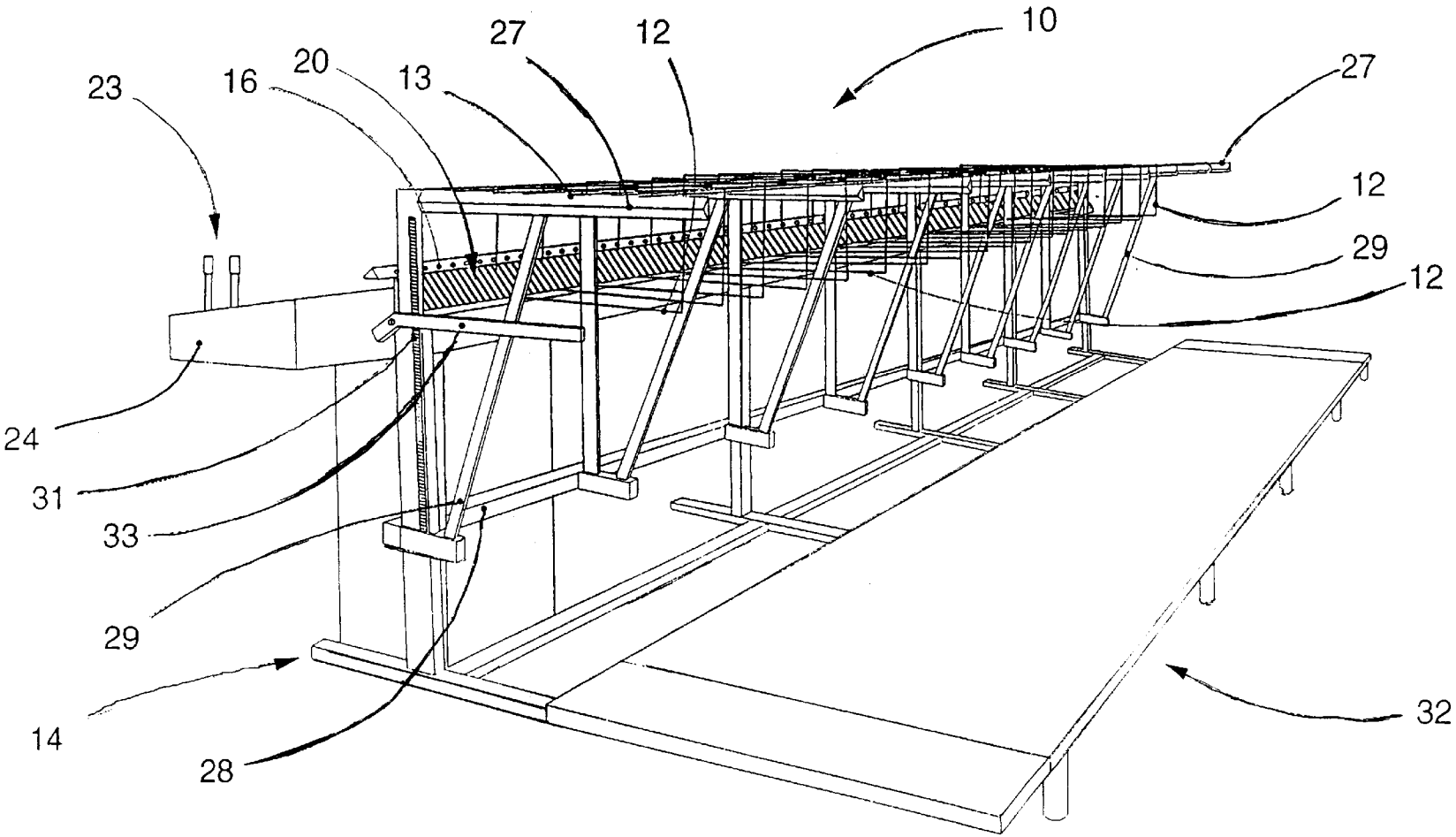
FIG. 2 shows the device of FIG. 1, in the embodiment with movable arms and stationary stirrups, in a different step of the cage-forming cycle.
Figure 3:
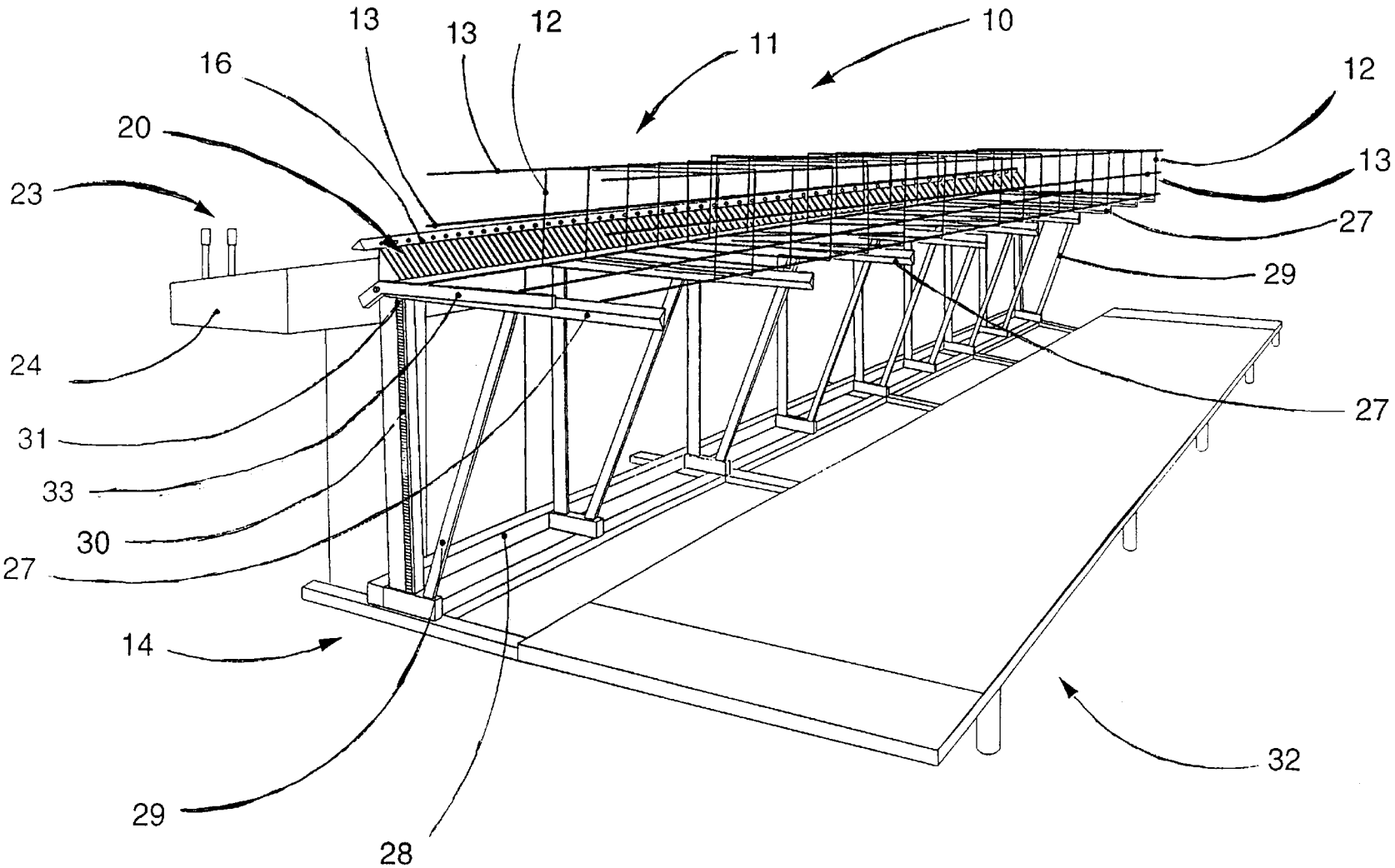
FIG. 3 shows the device of FIG. 1 with the finished cage.

In the specific case of FIGS. 1–3 the transverse arms 27 are associated at the lower part with a connection beam 28 and include stiffening rods 29 which prevent them from bending when they have a considerable weight to support.

Figure 12:
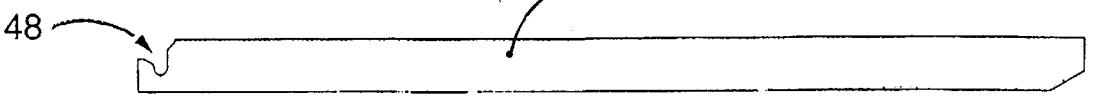
FIG. 12 shows an extension for transverse arms of the device to form cages according to the invention.
Figure 13:
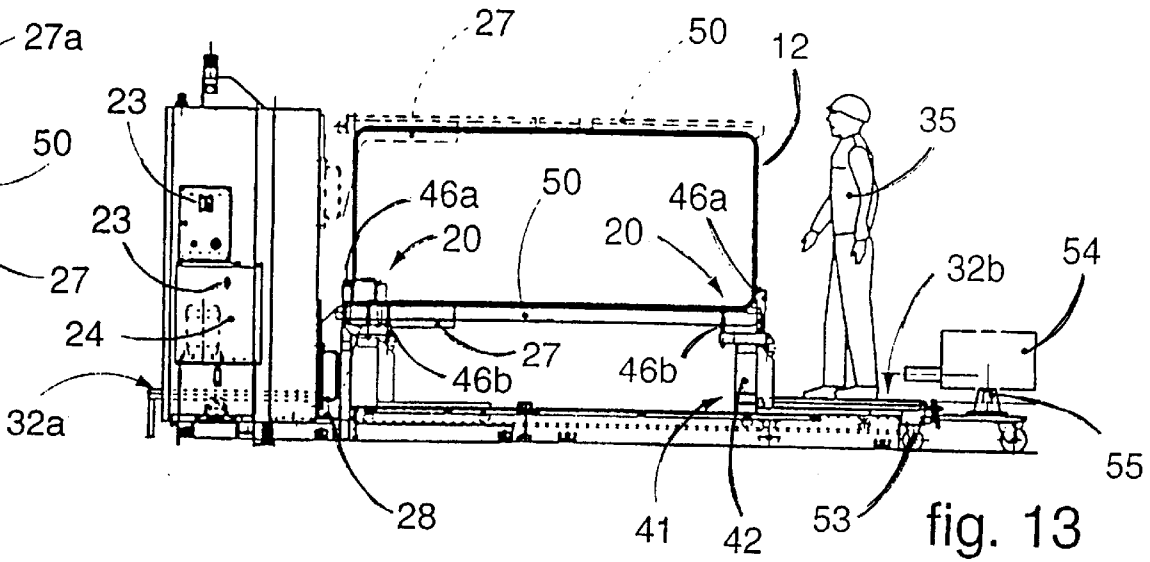
FIG. 13 is a front view of the device to form cages shown in FIG. 9.
Figure 11:
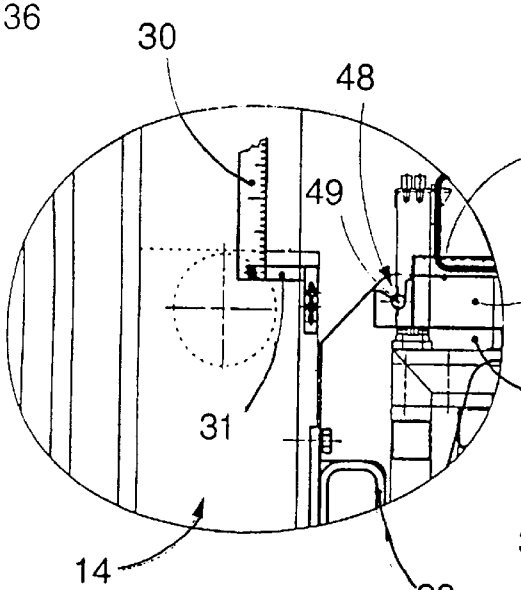
FIG. 11 shows a detail of the device to form cages according to the invention.
Figure 14A:
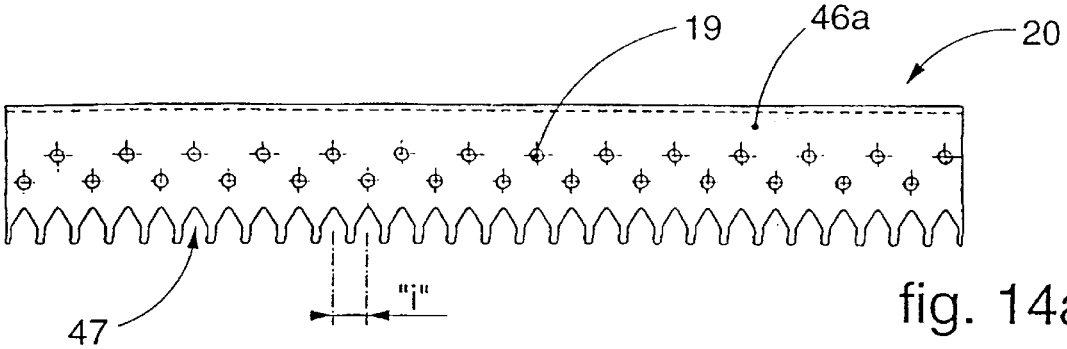
FIGS. 14*a*–14*b* show the means to retain and position the stirrups of the device to form cages shown in FIG. 9.
Figure 14B:
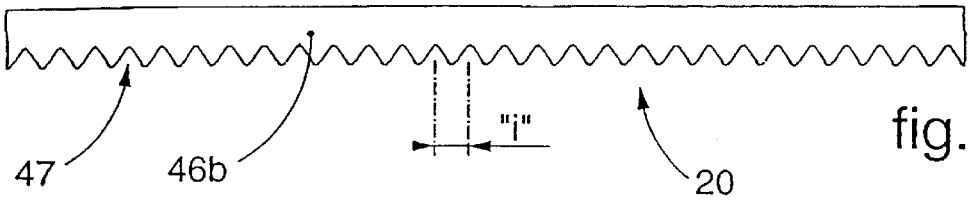
Figure 15:
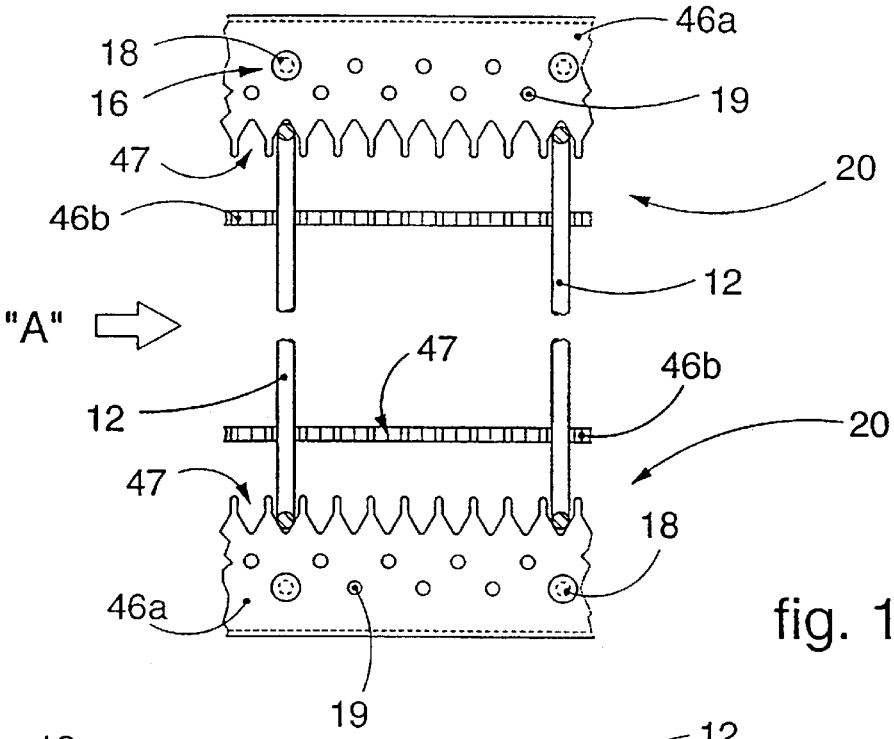
FIG. 15 is a diagram seen from above of a detail of the means to retain and position the stirrups shown in FIGS. 13–14.

In the embodiment shown in FIGS. 11–13 the transverse arms 27, which in this case too are attached to a connection beam 28, are able to be associated with extension elements 50 which allow the longitudinal rods 13 to be suitably supported and positioned whenever the cage 11 is of considerable width.

The extension elements 50 (FIG. 12) are of the type which can be replaced quickly; they are of variable length, and therefore are interchangeable according to the width of the cage 11 to be formed.

To be more exact, in correspondence with one end, the extension elements 50 have a groove 48 opening upwards into which horizontal attachment pins 49, solid with the transverse arms 27, are suitable to be inserted.

When the extension elements 50 are in a position of association with the attachment pins 49, they are aligned at their upper part with the transverse arms 27 and are supported below by the said transverse arms 27 (FIG. 11).

The extension elements 50 are removed simply by rotating them upwards and releasing them from the relative attachment pin 49.

According to a variant which is not shown here, at their upper part the transverse arms 27, and/or the extension elements 50, have guide elements suitable to assist the insertion and positioning of the longitudinal rods 13.

According to another variant the transverse arms 27 and/or the extension elements 50 are lined on the upper part with a wear-resistant material, in order to limit the deterioration caused by the sliding of the longitudinal rods 13.

In a preferential embodiment, the lining is of the type which can be replaced.

The transverse arms 27 are displaced upwards by means of the controls 23 on the control console 24, and the entity of the displacement is displayed on a graduated rod 30 which, in the case shown in FIGS. 1–3, is associated with the first of the transverse arms 27 and cooperates with a reference indicator 31 which is solid with the supporting frame 14 (FIGS. 1–3).

In the variant shown in FIG. 11 the graduated rod 30 is frontally associated with the supporting frame 14 and cooperates with an indicator 31 attached to the connection beam 28 of the transverse arms 27 and aligned with the upper profile 27*a* thereof.

When the transverse arms 27 are in the lowered position, the upper profile 27*a,* and therefore the indicator 31, are aligned with the "zero" of the graduated rod 30.

In the embodiment shown in FIG. 7, each transverse arm 27 is solidly associated with a relative trolley 36, which is able to slide by means of wheels 36*a* on a guide rod 37 with a vertical development which is solid with the supporting frame 14.

The trolley 36 is constrained to a chain 38 cooperating with a guide pulley 39*a,* solid with the supporting frame 14, and with a traction pulley 39*b* solid with an actuator 40 with vertical movement.

According to the position of the actuator 40, the chain 38 slides along the guide pulley 39*a* and causes the trolley 36 to move on the guide rod 37 and therefore positions the transverse arms 27 in the desired position.

In this case, the device 10 is associated with a raised side base 32 on which the worker 35 may stand in order to perform the operations to form the cage 11 in a more comfortable position.

There may also be, on the side base 32, a movable trolley, possibly mounted on the appropriate guide means, for the initial transport of the stirrups 12 or of technical equipment; this allows the stirrups 12 to be distributed more quickly and easily, and more in general, it facilitates the operations to assemble the cage 11.

There is a longitudinal supporting element 41 for wide stirrups 12 on the base 32.

The longitudinal supporting element 41 comprises a base structure 42 whose function is to support the stirrups 12 in correspondence with the side opposite that where the stirrups are clamped by the positioning and retaining means 20.

In this case, the base structure 42 is associated in such a way as to slide transversely to the base 32 on a guide 43, so that the longitudinal supporting element 41 can be moved from a first remote position on the base 32 to a position closer to the positioning and retaining means 20; the longitudinal supporting element 41 can thus be arranged in the desired position according to the transverse size of the stirrups 12 to support.

In the embodiment shown here, the longitudinal supporting element 41 is moved manually by the worker 35.

According to a variant, it can be moved in an automated manner.

In this case, moreover, auxiliary retaining means 44 are mounted on the base structure 42, by means of L bars 45, and consist of sections 25 substantially identical to those of the positioning and retaining means 20.

The auxiliary retaining means 44, into which the stirrups 12 are inserted during the positioning step, allow the stirrups 12 to be maintained more stably in an erect position, and at the same time guarantee a secure support.

In the embodiment shown in FIGS. 9, 10 and 13, the system to move the transverse arms 27 is substantially the same as that shown in FIG. 7, but in this case there are only two trolleys 36 associated with the connection beam 28, sliding on respective guide rods 37 on the ends of the device 10.

In this embodiment, the device to form cages 10 comprises two side bases 32, one stationary 32*a,* arranged between the guide rods 37, and one movable 32*b,* on the opposite side, on which the longitudinal support element 41 is associated.

The movable side base 32*b* is able to slide on guides 51 arranged transverse to the supporting frame 14 in order to adapt its position according to the width of the cage 11 to be formed.

In this case, the movable side base 32*b,* which rests on the ground on rollers 53, is moved manually by means of a hand wheel 52.

According to a variant which is not shown here, the system to move the movable side base 32*b* is of the driven type.

The longitudinal support element 41 comprises in this embodiment a base structure 42 on which a plurality of aligned L-shaped lateral profiles 46*a* and lower flat profiles 46*b* are mounted, mating with the corresponding profiles 46*a* and 46*b* associated with the supporting frame 14 of the device 10.

When the movable side base 32*b* is displaced transversely according to the width of the stirrups 12, all the elements to support the stirrups 12 are also displaced, making these operations to adapt the size and the subsequent operations to insert and pre-arrange the stirrups extremely rapid.

There are marker elements 16 also on the movable side base 32*b,* which makes it easier to position the stirrups 12.

There is also a rail 55 on the movable side base 32*b;* there is a trolley 54 assembled to slide thereon, which is suitable to support the welding device which can thus be taken to the most convenient position to carry out welding operations.

This configuration of the device 10 is extremely advantageous because it allows the operator 35 to perform the various steps of forming the cage 11 standing on the side bases 32*a* and 32*b* arranged on both sides thereof.

The inclusion of a longitudinal support element 41, stationary with respect to the movable side base 32*b,* gives the operator 35 greater ease of operation even when the cages 11 are of considerable width.

According to the variant shown in FIG. 6, the device 10 comprises vertically fixed transverse arms 27; in this embodiment the stirrups 12 are moved vertically from the start position as shown in FIG. 1 to a maximum low position wherein their upper side is arranged substantially to support the longitudinal rods 13 which rest on the transverse arms 27.

The procedure to form the cage 11 is as follows: first the stirrups 12 are introduced into the positioning and retaining means 20 indicated by the marker means 16, and the stirrups 12 are clamped in an erect position substantially orthogonal to the longitudinal plane on which the cage 11 lies by closing the positioning and retaining means 20 of the type as per FIG. 4, or by thrusting the stirrups 12 into the cuneiform seating if the positioning and retaining means 20 are of the type as shown in FIGS. 5, 7, 8 and 14*a*–16.

Subsequently, the longitudinal rods 13 are introduced inside the area defined by the stirrups 12; at this stage the transverse arms 27 are slightly raised with respect to their lowered position, or the stirrups 12 are slightly lowered, to allow the longitudinal rods 13 to be inserted better, with no risk of their knocking against the stirrups 12.

Then the transverse arms 27 are lowered again, or the stirrups 12 raised, and the leading ends of the longitudinal rods 13 resting on the stirrups 12 are aligned by means of an abutment element 33, in this case consisting of an oscillating rod associated with the forward end of the supporting frame 14 (FIG. 1).

The transverse arms 27, in the embodiment shown in FIGS. 2 and 3, are then raised until they take the longitudinal rods 13 to abut internally on the upper side of the stirrups 12 in correspondence with which the longitudinal rods 13 are attached, by welding or tying, in the number and position required (FIGS. 2, 4 and 7).

This operation of attachment is facilitated since both the stirrups 12 and the longitudinal rods 13 are maintained imposition, respectively by the positioning and retaining means 20 and the transverse arms 27, so that the worker 35 has his hands free to perform the operations.

Afterwards, as shown by the line of dashes in FIG. 4, the transverse arms 27 are progressively lowered and are arranged at the intermediate levels wherein the longitudinal rods 13 will possibly be attached.

The entity of this downward movement is displayed on the graduated rod 30, thus allowing the longitudinal rods 13 to be positioned accurately and easily, without the worker 35 having to take measurements.

The machine can be made to stop automatically in the positions wherein the longitudinal rods 13 have to be attached; this can be managed by the control unit of the machine after the worker 35, at the beginning of the work, has set the design parameters of the cage 11.

When the intermediate longitudinal rods 13 have been attached, the transverse arms 27 are lowered until the remaining longitudinal rods 13 are brought to rest on the lower side of the stirrups 12 and they too can be attached.

In the embodiment shown in FIG. 6, which is conceptually identical, the stirrups 12 are first completely lowered and then progressively raised and stopped, according to a visual verification of the graduated rod 30 or an automatic verification managed by the machine, in correspondence with the intermediate positions wherein the longitudinal rods 13 are to be attached.

In the case shown in FIGS. 1–6; the operation of attaching the longitudinal rod/rods 13 in correspondence with the comer of the stirrups 12 which cooperates with the positioning and retaining means 20 is performed by extracting from the side the already partly assembled cage 11 until the said comer is free (FIGS. 3 and 5).

For this purpose the transverse arms 27 are sufficiently long, with respect to the transverse size of the cage 11, to enable the cage 11 to be supported even when it is extracted at the side.

Figure 16:
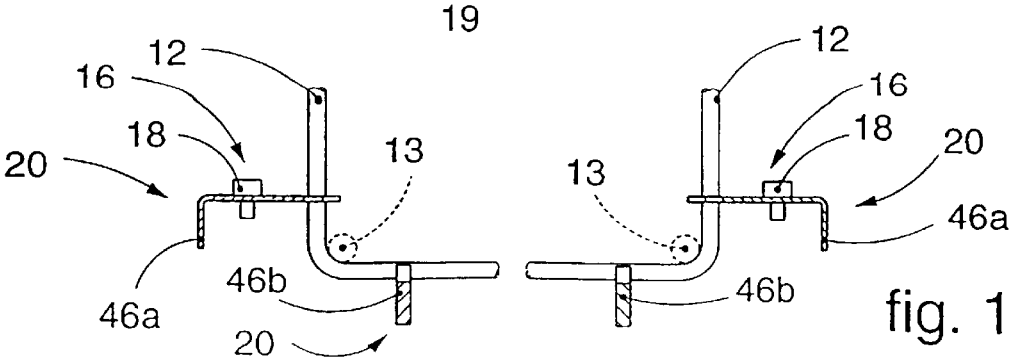
FIG. 16 is a view from A of FIG. 15.

In the embodiment shown in FIGS. 14*a*–16; when the longitudinal rods 13 are attached in correspondence with the comers of the stirrups 12 it is not necessary to extract the cage 11 laterally, since the profiles 46*a* and 46*b* are arranged in a position where they do not interfere with the said comers (FIG. 16).

What is claimed is:

1. Device to form metallic cages for structures made of reinforced concrete, the metallic cages comprising longitudinal rods associated width transverse stirrups, the transverse stirrups having an at least partly closed shape and being distanced lengthwise, the device comprising:

a supporting frame;

a plurality of housing seatings arranged in a longitudinal line on the supporting frame at least according to a desired interaxis ("i") or a submultiple of the desired interaxis ("i"), each of the housing seatings cooperating with positioning and retaining means to position and retain the stirrups defining their erect position on a substantially vertical plane;

a plurality of transverse arms to support the longitudinal rods liking separated from each other on a horizontal plane, the transverse arms being interposed between the housing seatings; and means for relative displacement in height between said transverse arms and said positioning and retaining means.

2. Device as in claim 1, wherein every housing seating is associated with marker means.

3. Device as in claim 1, wherein said transverse arms are movable in height from a position at least corresponding to a upper level of attachment of the longitudinal rods to a position at least corresponding to a lower level of attachment of the longitudinal rods.

4. Device as in claim 1, wherein said stirrups are movable in height from a position at least corresponding to a upper level of attachment of the longitudinal rods to a position at least corresponding to a lower level of attachment of the longitudinal rods.

5. Device as in claim 1 wherein said positioning and retaining means cooperate with a portion of the stirrup.

6. Device as in claim 1, further comprising an autonomous supporting means solidly connected to the supporting frame for supporting the stirrups positioned on the transverse arms.

7. Device as in claim 1, wherein the interaxis ("i") of said housing seatings is a submultiple of the desired interaxes of the stirrups of the metallic cages to be formed.

8. Device as in claim 7, wherein said interaxis ("i") of said housing seatings is 25 mm.

9. Device as in claim 1, wherein said positioning and retaining means are solidly connected to the housing seatings.

10. Device as in claim 1, wherein said positioning and retaining means can be removed from the relative housing seatings.

11. Device as in claim 1, wherein each of said positioning and retaining means comprises a pair of sections of which at least one is movable, the movable section having a first wider position wherein the stirrup is inserted and contained, and a second closed position wherein the stirrup is clamped.

12. Device as in claim 11, wherein said movable sections of the positioning and retaining means are associated with a single moving element.

13. Device as in claim 1, wherein each of said positioning and retaining means comprises sections which have at the rear or on the base at least a cuneiform segment to contain and retain the relative stirrup.

14. Device as in claim 13, wherein said sections can be associated by rapid attachment with the relative housing seatings.

15. Device as in claim 1, wherein said positioning and retaining means comprise wedge-shaped hollows to contain and retain the stirrups made on profiles arranged along the length of the device.

16. Device as in claim 15, wherein some of the wedge-shaped hollows are provided on lateral profiles suitable to cooperate with lateral segments of the stirrups and others of the wedge-shaped hollows are provided on lower profiles suitable to cooperate with lower segments of the stirrups.

17. Device as in claim 16, wherein the profiles comprise two longitudinal rows of said lateral profiles, arranged parallel and opposite each other at a distance corresponding to a width of the stirrups, and two longitudinal rows of said lower profiles arranged parallel, inside and on a lower plane than that of the lateral profiles, the lower profiles defining a plane on which the stirrups rest and are supported.

18. Device as in claim 17, wherein at least one longitudinal row of said lateral profiles and at least one longitudinal row of said lower profiles is movable laterally.

19. Device as in claim 1, wherein said positioning and retaining means are movable lengthwise relative to the supporting frame.

20. Device as in claim 2, wherein the marker means comprises LEDs.

21. Device as in claim 2, wherein said marker means comprises pins which can be inserted into/removed from holes arranged in a mating position with the housing seatings.

22. Device as in claim 2, wherein said marker means comprises a continuous, longitudinally extending element that can be moved lengthwise relative to the frame, said element having markers spaced apart thereon.

23. Device as in claim 1, wherein said transverse arms, or said positioning and retaining means, are associated with graduated rod means with a reference indicator to measure and display the relative displacement in height.

24. Device as in claim 1, wherein said transverse arms are able to be associated with interchangeable extension elements of varying length.

25. Device as in claim 24, wherein each of said extension elements comprises a quick coupling connection to the transverse arms.

26. Device as in claim 24, wherein said transverse arms include seatings to guide and contain the longitudinal rods.

27. Device as in claim 24, wherein at least an upper part of said transverse arms and said extension elements include a lining of wear-resistant material.

28. Device as in claim 27, wherein said lining of wear-resistant material is replaceable with another lining.

29. Device as in claim 1, further comprising, in correspondence with one end of the supporting frame, an abutment element arranged substantially parallel to the transverse arms, said abutment element defining the position of alignment of the leading ends of said longitudinal rods.

30. Device as in claim 1, further comprising a control console with commands for automated movement of said transverse arms.

31. Device as in claim 1, further comprising at least a side base with a lengthwise extension mating with the length of the supporting frame.

32. Device as in claim 31, wherein said side base is associated with at least a longitudinal element to support wide stirrups.

33. Device as in claim 32, wherein said longitudinal supporting element is movable transversely with respect to the side base.

34. Device as in claim 31, wherein said side base is movable transversely with respect to the supporting frame and comprises a row of lateral profiles and a row of lower profiles to support and retain the stirrups.

35. Device as in claim 34, wherein at least said lateral profiles are associated with relative marker means to position the stirrups.

36. Device as in claim 33, further comprising means for automating movement of at least one of said longitudinal supporting element and said side base.

37. Device as in claim 32, wherein said longitudinal supporting element includes auxiliary means to retain the stirrups cooperating with the positioning and retaining means.

38. Device as in claim 28, wherein said side base includes a movable trolley to transport at least one of the stirrups and technical equipment, said movable trolley being mounted on a guide and sliding means.

39. Device as in claim 30, wherein the control console includes commands to condition the positioning and retaining means.

40. Device as in claim 32, wherein said extension elements include: seatings to guide and contain the longitudinal rods.

* * * * *

UNITED STATES PATENT AND TRADEMARK OFFICE

CERTIFICATE OF CORRECTION

PATENT NO. : 6,560,834 B1
DATED : May 13, 2003
INVENTOR(S) : Wirth et al.

It is certified that error appears in the above-identified patent and that said Letters Patent is hereby corrected as shown below:

Title page,
Please correct Item as follows: -- [73] M.E.P. Macchine Elettroniche Piegatrici SpA, Italy --.

Signed and Sealed this

Seventeenth Day of August, 2004

JON W. DUDAS
*Acting Director of the United States Patent and Trademark Office*